US005195343A

United States Patent [19]

Malarz

[11] Patent Number: 5,195,343

[45] Date of Patent: Mar. 23, 1993

[54] PUSHER APPARATUS FOR MULTI-AXIS TUBE BENDER

[75] Inventor: Antoni J. Malarz, Troy, Mich.

[73] Assignee: General Motors Corporation, Detroit, Mich.

[21] Appl. No.: 888,088

[22] Filed: May 26, 1992

[51] Int. Cl.[5] ..... B21B 39/02; B21D 9/05

[52] U.S. Cl. ..... 72/133; 72/150; 72/466

[58] Field of Search ..... 72/133, 150, 364, 370, 72/387, 466

[56] References Cited

U.S. PATENT DOCUMENTS

| | | | |
|---|---|---|---|
| 2,303,058 | 11/1942 | Misfeldt | 72/150 |
| 2,399,892 | 5/1946 | Sato | 72/150 |
| 2,465,101 | 3/1949 | Johnson | 72/150 |
| 3,650,136 | 3/1972 | Sindelar | 72/150 |
| 4,123,930 | 11/1978 | Hill et al. | 72/466 |
| 4,391,116 | 7/1983 | Yogo | 72/168 |
| 4,495,788 | 1/1985 | Traub | 72/157 |
| 4,727,738 | 3/1988 | Yogo | 72/157 |
| 4,744,233 | 5/1988 | Trudell | 72/150 |
| 4,938,047 | 7/1990 | Yogo et al. | 72/149 |
| 5,031,291 | 7/1991 | Shimokata | 29/33 |

FOREIGN PATENT DOCUMENTS

| | | | |
|---|---|---|---|
| 02-35523 | 9/1990 | Japan | 72/150 |
| 2139534 | 6/1983 | United Kingdom . | |

*Primary Examiner*—Lowell A. Larson
*Assistant Examiner*—Michael J. McKeon
*Attorney, Agent, or Firm*—Patrick M. Griffin

[57] ABSTRACT

A pusher bar assembly for a multi-axis tube bender acts to insert and withdraw the bending support mandrel, as well as to push the tube through the bender. A hollow sleeve with a diameter equal to the tube has sufficient length to contain both the mandrel and a piloting plug, which can be inserted between the free ends of both the tube and sleeve. A mandrel bar is slidably received through the sleeve, and so can extend the mandrel out of a stored position of the sleeve into the tube and back. A stop means stops the mandrel bar to locate the mandrel at the proper place in the tube. A push pull means on the mandrel bar also pushes the plug to a point where it bridges the free ends of the tube and sleeve with the mandrel stops. Therefore, a high pushing force can be directed from the sleeve to the tube without the free ends collapsing inside one another.

2 Claims, 2 Drawing Sheets

PUSHER APPARATUS FOR MULTI-AXIS TUBE BENDER

This invention relates to multi-axis tube bending in general, and specifically to an apparatus for pushing a tube through such a bending apparatus.

BACKGROUND OF THE INVENTION

Under the old, manual method of tube bending, a tube was advanced manually through a fixed die and a manual die one small increment at a time, and the movable die was pivoted so as to bend the tube to the desired curvature. Such a process was obviously time-consuming and difficult to carry out precisely. New, automatic bending machines, called multi-axis benders, speed the tube bending process and its precision by forcing the tube continuously through the fixed and movable dies, with the movable die being preprogrammed to swing in a pattern that will continuously bend the tube into the desired shape. A great deal of axial pushing force has to be applied to the tube as it is fed through the dies, and it has to be supported along its length as this force is applied. Typically, the tube is encased in a close fitting channel as it moves, to keep it from buckling. A pusher apparatus is driven forcefully by some drive mechanism, such as a ball screw machine, along the same channel, to push the tube though the channel. Some part of the pusher apparatus extends out to the side of the channel, through a slit or the like, so that it can be moved along by the drive mechanism.

Some part of the pusher apparatus has to directly, physically engage the tube as it is pushed through the channel. This structure will have to fit inside the same channel as the tube it is pushing, and so, ideally, will have the same shape as the tube. Most conveniently, a piece of tube just like the tube being bent would be used. However, there is nothing to keep the pusher tube from collapsing inside of the pushed tube, especially under the high forces involved. As well as the need to support the outside of the tube as it is forced through the channel, there is a need to maintain the inside of the tube against collapse as it is bent by the dies. Flexible mandrels exist that make a close, slip fit inside that section of the tube that is being continuously bent, which is that part of the tube that is located between the fixed and movable dies. It is necessary to somehow insert and withdraw these mandrels into and from the tubes, and to keep them located between the fixed and movable dies as the tube is being pushed through the dies.

SUMMARY OF THE INVENTION

The invention provides an apparatus that prevents the pusher bar from collapsing inside the tube and also cooperates in inserting, withdrawing, and properly locating the bending mandrel.

In the preferred embodiment disclosed, the flexible bending mandrel has a length substantially equal to the bend length distance between the fixed and movable dies. The pusher bar apparatus has a hollow sleeve with a diameter equal to the tube, so that its free end can abut the free end of the tube within the guide channel. In order to keep the sleeve from collapsing inside the tube, a piloting plug with a diameter equal to the inner diameter of each is used, with enough axial thickness to fit far enough into both to mutually support them. The interior length of the hollow sleeve is long enough to contain both the mandrel and the plug.

In order to move both the piloting plug and mandrel to their proper locations in use, a mandrel bar, which is substantially smaller in diameter than the sleeve, is slidably received through both the sleeve and the plug. The inner end of the mandrel bar is connected to the mandrel, while the other end is driven independently of the pusher bar assembly by its own drive mechanism, to either pull the mandrel and withdraw it from the tube and back into the sleeve, or to push the mandrel and extend it out of the sleeve and into the tube. As the mandrel extends into the tube, a stop means stops it when it reaches the proper location within the tube, that is, between the fixed and movable dies.

As the mandrel bar is initially carrying the mandrel to its operating position, a one-way, releasable latch means engages between the mandrel bar and the plug to pick up the plug and take it to its operative location, where it extends about halfway out of the free end of the hollow sleeve, and an equal distance into the free end of the tube. Thereafter, as the pusher bar assembly moves and the mandrel bar is held fast, the plug overides the mandrel bar latch, there being enough friction to carry it along with the moving sleeve and tube to supports their free ends against mutual collapse. The mandrel remains in its operative location as the tube slides over it. When the bending operation is complete, the mandrel bar is pulled back. The plug is pulled back into the sleeve, either by the friction of the mandrel bar sliding through it, or, by the mandrel eventually hitting it and pulling it back. The mandrel bar also pulls the mandrel back into the sleeve, where both it and the plug are protected and stored. Both the plug and the mandrel re-extend when the bending operation is begun again.

It is, therefore, a general object of the invention to provide a pusher bar assembly for a multi-axis bender that is well supported against the tube that it is pushing.

It is another object of the invention to provide a pusher bar assembly in which a piloting plug is automatically set to the proper location to fit within the free ends of both the pusher bar assembly and the tube it is pushing.

It is another object of the invention to provide a pusher bar assembly in which the piloting plug and mandrel are both automatically withdrawn to a stored and protected position at the end of the bending cycle.

DESCRIPTION OF THE PREFERRED EMBODIMENT

These and other objects and features of the invention will appear from the following written description and from the drawings, in which.

Figure 1:
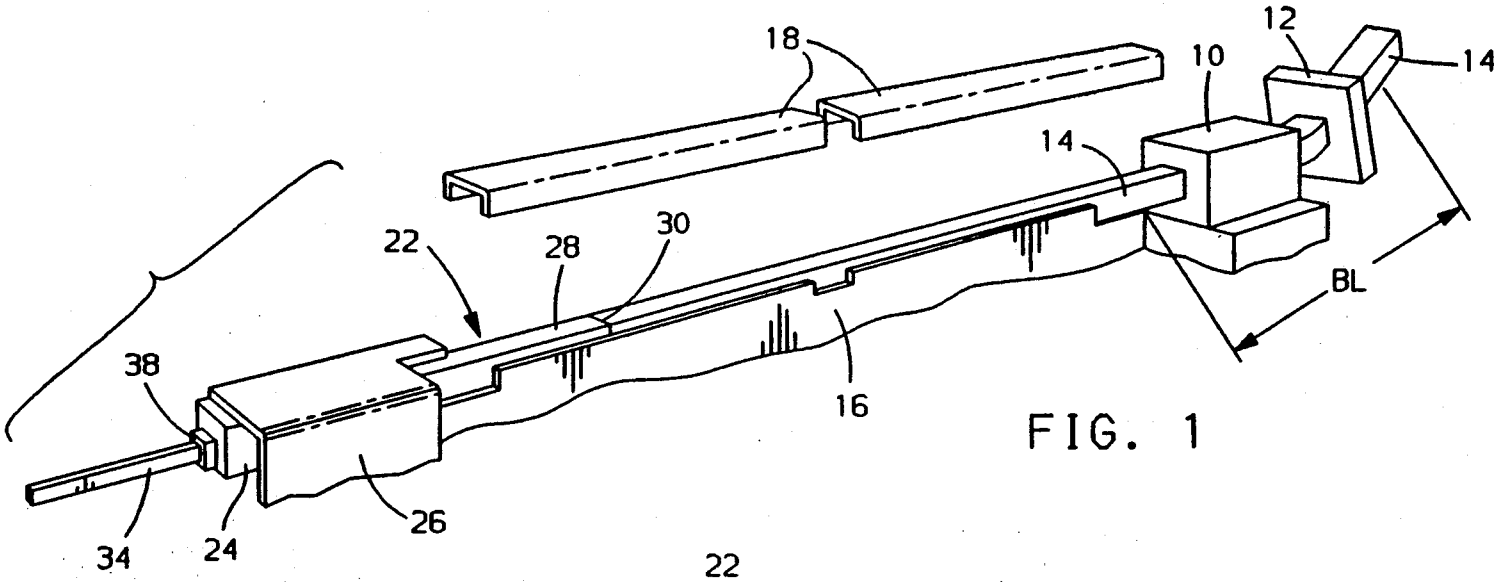
FIG. 1 is a partially schematic perspective view of a multi-axis bender incorporating the pusher bar assembly of the invention.
Figure 2:
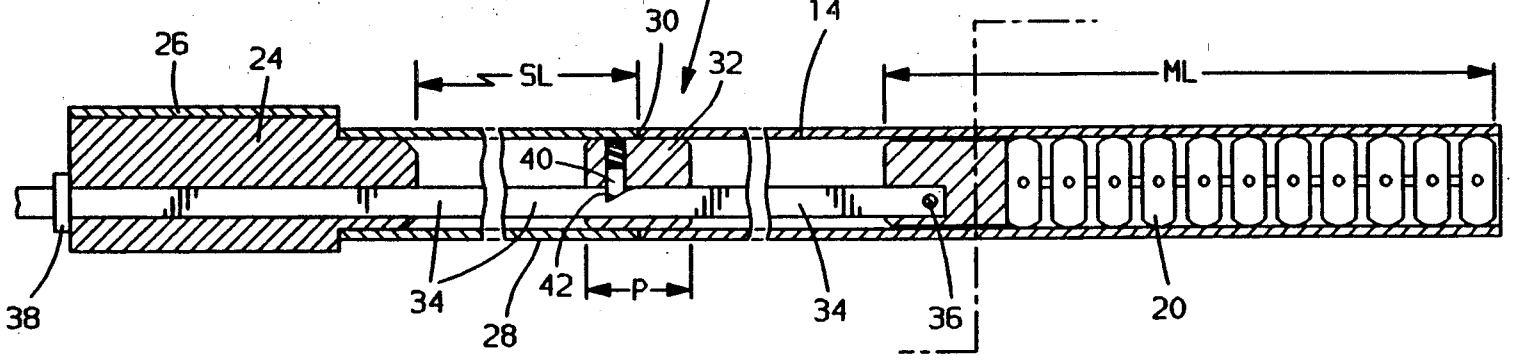
FIG. 2 is a cross section through a preferred embodiment of the pusher bar assembly of the invention showing the mandrel in extended, operative position, just after the mandrel bar has stopped and just before the tube begins to move through the dies.

Referred first to FIGS. 1 and 2, a typical multi-axis tube bender includes a fixed die and a movable die, which are indicated in simplified fashion at (10) and (12) respectively. A tube (14) is shown in the process of being bent through the dies (10) and (12). Tube (14) would typically be a thin wall steel tube, which would be bent into the proper shape to make up part of a vehicle space frame or the like. Not all of tube (14) would be bent, but a defined, predetermined length of it would, indicated as bend length BL in FIG. 1. The balance of tube (14) needs to be supported against buckling as the rest of it is being bent, and the interior of the bend length needs to be supported against buckling, as well. To support the exterior of tube (14), a rigid, shape matched channel (16) is provided. Guide bars (18) are supported over the top of channel (16) by other, non-illustrated structure, but do not come down all the way to the top of channel (16), so as to leave a slit. To support the interior of the bend length of tube (14), a commercially available flexible mandrel (20) is used. Mandrel (20) makes a close slip fit inside the bend length of tube (14), bending with it to support its interior profile. The length of mandrel (20), indicated at ML, is substantially equal to the distance between the fixed die (10) and movable die (12). The invention handles and locates mandrel (20), among other things.

Still referring to FIGS. 1 and 2, the pusher bar assembly of the invention, indicated generally at (22), includes a solid base (24) sized to fit slidably within guide channel (16), and a drive flange (26) fixed to the top of base (24). Drive flange (26) would run through the slit created between guide channel (16) and guide bars (18), described above. A large axial pushing force would be selectively applied to flange (26) and base (24) by a suitable drive mechanism, not illustrated, such as a ball screw machine. Fixed to base (24) is a hollow sleeve (28), which is cut from the same stock as tube (14), and so has the same cross sectional shape and wall thickness. Therefore, the free ends of hollow sleeve (28) and tube (14) can be abutted exactly, as shown at the interface indicated at (30). If a high axial force were applied at the interface (30), however, one or the other of the tube (14) and hollow sleeve (28) could collapse inside the other. To prevent that, a piloting plug (32) is provided, which has an axial thickness indicated at P sufficient to support the ends of the tube (14) and sleeve (28). For example, if plug (32) is six inches thick, then about three inches of it can extend to either side of interface (30), providing sufficient mutual support. The interior length of sleeve (28), SL, is at least equal to ML plus P, for a purpose described below.

Figure 3:
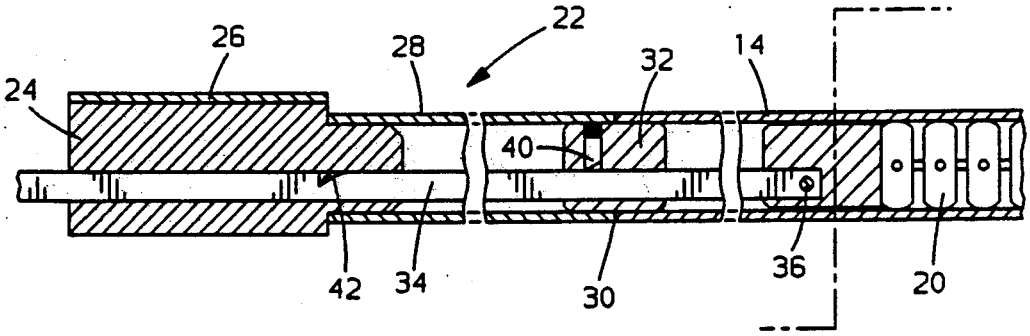
FIG. 3 shows the tube after the pusher bar assembly has pushed it almost all the way through the dies.

Referring next to FIGS. 2 and 3, additional structure that acts to properly locate plug (32) and mandrel (20) in operation is described. A long, thin mandrel bar (34) is thin enough to slide through sleeve (28) with clearance, and also slide closely through base (24) and plug (32). Mandrel (20) is attached by a pivot pin (36) to the inner end or mandrel bar (34). The outer end of mandrel bar (34) would be attached to a non-illustrated drive mechanism similar to that which drives pusher bar assembly (22), although it need not be capable of applying nearly so high an axial pushing force. The two drive mechanisms would be capable of operating independently. In order to properly locate mandrel (20), a stop means, here a stop collar (38), is located so as to hit base (24) when mandrel bar (34) has extended far enough to put mandrel (20) in its operative location, that is, between the dies (10) and (12). In order to locate plug (32) in the FIG. 2 position, a releasable latch acts between mandrel bar (34) and plug (32). As disclosed, the latch means consists of a spring-loaded detent plunger (40) and a sawtooth shaped slot (42) in mandrel bar (34). The sawtoothed, asymmetrical ramp shape of slot (42) means that the plunger (40) will tend to lock into it when mandrel bar (34) is being pushed to the right, relative to plug (32), and to pop out of it when mandrel bar (34) is being pulled relatively to the left.

Figure 5:
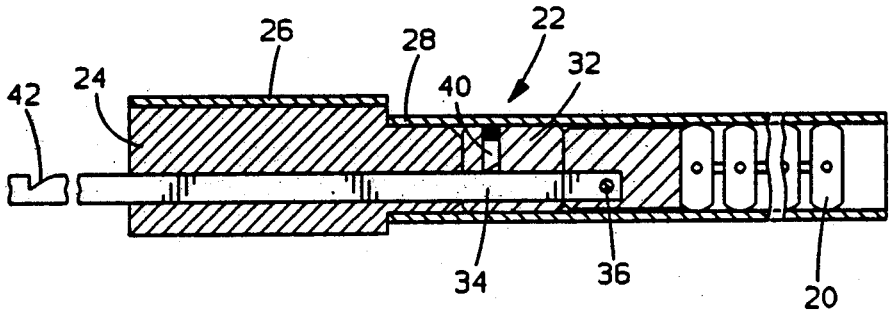
FIG. 5 shows the mandrel bar pulled back all the way, with the mandrel and plug fully withdrawn and stored.

Referring next to FIGS. 1 and 5, the initial operation of pusher bar assembly (22) is illustrated. Plug (32) and mandrel (20) begin in a protected, stored position, sheltered within the hollow length of sleeve (28). The sleeve length SL described above is sufficient to assure that this is possible. The mandrel bar (34) has been withdrawn as far as it will go through base (24) and plug (32), so the slot (42) is located well outside of sleeve (28), and the plunger (40) rides lightly on the top edge of bar (34). In addition, pusher bar assembly (22) would be pulled back by its drive mechanism far enough to admit tube (14) into channel (16), which is farther back than is actually shown in FIG. 1, since some bending has already taken place in FIG. 1.

Comparing FIGS. 5 and 2, the next step in the operation of assembly (22) is illustrated. With mandrel (20) and plug (32) in the FIG. 5 storage position, tube (14) can be placed in guide channel (16) with the free ends of sleeve (28) and tube (14) abutted at the interface (30). A reference plane is shown in FIG. 2 by the dotted line, which does not represent any particular point, but which is a fixed plane relative to the dies (10) and (12), so as to graphically indicate relative motion. After tube (14) is in place, pusher bar assembly (22) remains stationary as mandrel bar (34) is pushed relatively to the right by its drive mechanism. This extends mandrel (20) out of sleeve (28) and eventually into tube (14). As noted above, when stop collar (38) hits base (24), mandrel (20) will be properly located within the bend length of tube (14). Where collar (38) is fixed to mandrel bar (34) is determined, therefore, by how far the area between the dies (10) and (12) is axially spaced from the end of base (24), and will vary from case-to-case. As mandrel bar (34) initially extends, it slides through the pusher assembly base (24) and through the plug (32), which is held by some friction within sleeve (28), until the slot (42) moves into alignment with the spring-loaded plunger (40), which then pops into slot (42). Plug (32) is then picked up and carried with mandrel bar (34) until it extends partially out of the free end of sleeve (28) by about half of its axial thickness P, and, therefore, a roughly equal amount into the free end of tube (14). This relationship is assured if the distance between slot (42) and stop collar (38) is approximately equal to the length of base (24) plus the sleeve length SL, assuming that the plunger (40) is about in the center of plug (32).

Referring to FIGS. 2 and 3, the operation of pusher bar assembly during the actual bending of tube (14) is illustrated. After plug (32) has moved to the operative, tube piloting position, of FIG. 2, the drive mechanism for the pusher bar assembly (22) can be started, while the mechanism for the mandrel bar (34) is programmed to simply hold the mandrel bar 34 stationary. The axial pushing force from assembly (22) is directly applied to tube (14), and it begins to slide through the dies (10) and (12) to be bent. There is enough friction between the plug (32) and the moving sleeve (28) and tube (14) to carry plug (32) along at the interface (30), overriding the latch and pulling pin (40) out of slot (42), as shown.

During the bending process, as tube (14) slides over mandrel (20), the presence of plug (32) at the interface (30) keeps the free ends of sleeve (28) and tube (14) from collapsing inside each other, as if each were effectively solid, not hollow. As can be seen by the relative location of the dotted line reference plane, both sleeve (28) and mandrel (20) have moved significantly to the right, and the bending of tube (14) is substantially complete.

Figure 4:
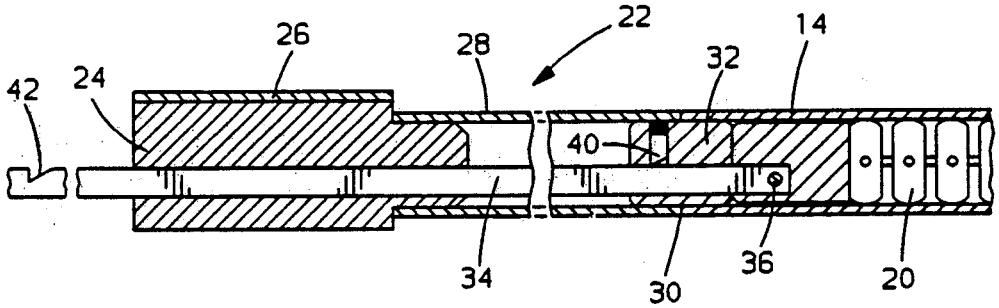
FIG. 4 shows the mandrel bar in the process of pulling back after the bending process is complete, with the plug fully withdrawn and the mandrel in the process of withdrawing.

Referring next to FIGS. 4 and 5, the completion of the bending cycle is illustrated. Some other, non-illustrated stop means on the drive mechanism of pusher bar assembly (22) would indicate when the entire bend length of tube (14) had passed through the dies (10) and (12). At that point, pusher bar assembly (22) remains stationary and the mandrel bar (34) is pulled back, withdrawing mandrel (20) from the now bent tube (14), as shown in FIG. 4. Plug (32) may be pulled back simply by the friction of mandrel bar (34) sliding through it or, if not, then the inner end of the mandrel (20) itself will hit it, as shown in FIG. 4. Either way, plug (32) will eventually be withdrawn all the way back into sleeve (28), far enough to hit base (24), as shown in FIG. 5. Mandrel (20) will also be withdrawn inside of sleeve (28), stored and ready for another cycle.

Variations in the preferred embodiment could be made. A different means could be used to selectively push the plug (32) to its extended, operative position, and pull in back into sleeve (28). For example, a pin through mandrel bar (34) located just behind plug (32), in the FIG. 2 position, could replace both the plunger (40) and slot (42). A large enough slot through base (24) to accommodate such a pin would be possible. Such a pin would act like a lost motion mechanism, in effect, pushing plug (32) forward from the FIG. 5 storage position to the FIG. 2 operative position as mandrel bar (34) extended. It would not directly pull plug (32) back to the stored position, but the mandrel (20) does that. Another advantage of such a pin would be that several holes could be drilled through mandrel bar (34) to located the pin at several different locations, thereby accommodating different length mandrels (20) (assuming that sleeve (28) was long enough to accommodate different mandrels. Theoretically, if the bend length of tube (14) was fairly close to the free end of tube (14), then the plug (32) could be simply fixed to mandrel bar (34) at the proper location to extend partially out of sleeve (28) when mandrel (20) was fully extended. Sleeve (28) would have to be longer, then, because plug (32) and mandrel (20) would not be closed up and abutted inside sleeve (28) in as compact a stored position. A stop means other than the stop collar (38) on mandrel bar (34) could be used to stop the mandrel bar drive mechanism when mandrel (20) was properly located. For example, a simple limit switch could be incorporated into the mandrel bar drive mechanism that was set for each particular tube (14) to engage when the mandrel bar (34) had extended far enough to position mandrel (20). Therefore, it will be understood that it is not intended to limit the invention to just the embodiment disclosed.

The embodiments of the invention in which an exclusive property or privilege is claimed are defined as follows:

1. For use with a tube bending machine in which a tube having a free end is continuously pushed under force along its axis through a fixed die and a movable die in order to continuously bend a curvature into said tube, an apparatus for applying pushing force to said tube as it is bent, comprising, a flexible bending mandrel having a length substantially equal to the distance between said fixed and movable die and sized to make a close slip fit inside of said tube so as to maintain the shape of said tube as it is bent, a mandrel bar connected to said mandrel and adapted to slide independently to extend said mandrel axially into said tube or to pull said mandrel and withdraw it from said tube, a stop means to stop said mandrel bar when said mandrel is located within said tube between said fixed and movable die, a piloting plug sized to make a close slip fit inside of said tube and operatively attached to said mandrel bar so as to extend partially into said tube free end when said stop means is engaged, a pusher bar assembly having a hollow sleeve through which said mandrel bar is slidably received with a diameter substantially equal to said tube and a free end so as to be abuttable with said tube free end, said hollow sleeve also having an interior length sufficient to receive said mandrel and plug therewithin when said mandrel is withdrawn, whereby, said mandrel bar may be pulled to withdraw said plug and mandrel to a stored position within said hollow sleeve, from which stored position said hollow sleeve free end may be abutted with said tube free end and said mandrel bar pushed independently through said hollow sleeve and plug to extend said mandrel and plug until said stop means engages, assuring that said plug extends out of said hollow sleeve and partially into said tube free end, thereby allowing said pusher bar to apply a pushing force to said tube as it is bent and supported by said mandrel, after which said mandrel bar may be pulled back to again withdraw said mandrel and plug to stored position.

2. For use with a tube bending machine in which a tube having a free end is continuously pushed under force along its axis through a fixed die and a movable die in order to continuously bend a curvature into said tube, an apparatus for applying pushing force to said tube as it is bent, comprising, a flexible bending mandrel having an axial length substantially equal to the distance between said fixed and movable die and sized to make a close slip fit inside of said tube so as to maintain the shape of said tube as it is bent, a piloting plug sized to make a close slip fit inside of said tube and having a predetermined axial thickness, a pusher bar assembly having a hollow sleeve with a diameter substantially equal to said tube and a free end abuttable with said tube free end, said hollow sleeve also having an axial interior length at least equal to the sum of said mandrel axial length and plug axial thickness, a mandrel bar connected to said mandrel and adapted to slide independently of said pusher bar assembly axially through said hollow sleeve and through said plug so as to push said mandrel, tending to extend it axially out of said hollow sleeve, or to pull said mandrel, tending to withdraw it axially into said hollow sleeve, a stop means to stop said mandrel bar when said mandrel is located within said tube between said fixed and movable die, and, push-pull means engageable between said mandrel bar and said plug to push said plug with said mandrel pull bar when said mandrel bar is extending and pull said plug when said mandrel bar is withdrawing, said push-pull means being located on said mandrel bar, relative to said mandrel, such that, when said stop means is engaged, said plug extends partially out of said hollow sleeve, whereby, said mandrel bar may be pulled to withdraw said plug and mandrel to a stored position within said hollow sleeve, from which stored position said hollow sleeve free end may be abutted with said tube free end and said mandrel bar pushed independently through said hollow sleeve and plug to extend said assuring that said plug extends out of said hollow sleeve far enough to fit within both said hollow sleeve and tube free ends, thereby allowing said pusher bar to apply a pushing force to said tube as it is bent and supported by said mandrel, after which said mandrel bar may be pulled back to again withdraw said mandrel and plug to stored position.

* * * * *